US009841718B2

(12) United States Patent
Ogura et al.

(10) Patent No.: US 9,841,718 B2
(45) Date of Patent: Dec. 12, 2017

(54) LUBRICANT APPLICATOR, CLEANING DEVICE, AND IMAGE FORMING APPARATUS

(71) Applicant: Konica Minolta, Inc., Tokyo (JP)

(72) Inventors: Kunihiro Ogura, Hino (JP); Yukio Hosoya, Tama (JP); Taiki Amemiya, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/348,281

(22) Filed: Nov. 10, 2016

(65) Prior Publication Data

US 2017/0160696 A1 Jun. 8, 2017

(30) Foreign Application Priority Data

Dec. 8, 2015 (JP) ..... 2015-239741

(51) Int. Cl.
*G03G 21/00* (2006.01)

(52) U.S. Cl.
CPC ..... *G03G 21/0094* (2013.01); *G03G 21/0011* (2013.01)

(58) Field of Classification Search
CPC ..... G03G 21/0011; G03G 21/0094
See application file for complete search history.

(56) References Cited

U.S. PATENT DOCUMENTS

2009/0185842 A1* 7/2009 Hatori ..... G03G 21/0011 399/346
2011/0164909 A1* 7/2011 Nakane ..... G03G 21/007 399/346

FOREIGN PATENT DOCUMENTS

JP 2010133997 A 6/2010
JP 2011170155 A 9/2011
JP 2015106004 A 6/2015

* cited by examiner

*Primary Examiner* — Hoang Ngo
(74) *Attorney, Agent, or Firm* — Lucas & Mercanti, LLP

(57) ABSTRACT

A lubricant applicator incorporated in a cleaning device disposed in an image forming apparatus having an image bearing member on which an image containing toner is formed, includes: a lubricant supplying unit that supplies lubricant; a brush roller that scrapes off the lubricant to apply the lubricant to a surface of the image bearing member; and a flicker member positioned on an upstream side from the lubricant supplying unit in a rotation direction of the brush roller, the flicker member coming into contact with the brush roller, wherein the flicker member is a plate-shaped member in which an opening is formed, the flicker member having elasticity to be allowed to elastically rock by coming into contact with the brush roller, and the opening is formed in a region with which the brush roller comes into contact.

10 Claims, 7 Drawing Sheets

FIG. 12

| | OPENING RATIO [%] | THICKNESS OF FLICKER MEMBER [μm] | SPECIFICATIONS OF BRUSH BRISTLE | | | | | IMAGE QUALITY EVALUATION | |
|---|---|---|---|---|---|---|---|---|---|
| | | | MATERIAL | SHAPE (LOOP FORMATION PLANE) | FINENESS [d] | DENSITY [kF/(inch)$^2$] | BRISTLE LENGTH [mm] | AFTER PRINTING 25,000 PIECES | AFTER PRINTING 50,000 PIECES |
| EXAMPLE 1 | 30 | 300 | ACRYLIC | STRAIGHT BRISTLE | 6 | 100 | 3.0 | B | B |
| EXAMPLE 2 | 50 | 100 | POLYESTER | TWO DIRECTIONS | 6 | 40 | 3.0 | A | B |
| EXAMPLE 3 | 60 | 200 | POLYESTER | ONE DIRECTION | 10 | 40 | 3.0 | A | A |
| EXAMPLE 4 | 60 | 200 | POLYESTER | ONE DIRECTION (INCLINED) | 10 | 40 | 3.0 | A | A |
| EXAMPLE 5 | 50 | 50 | POLYESTER | ONE DIRECTION | 3 | 100 | 4.0 | A | A |
| EXAMPLE 6 | 80 | 25 | POLYESTER | ONE DIRECTION | 3 | 225 | 3.0 | A | A |
| COMPARATIVE EXAMPLE 1 | 30 | 500 | POLYESTER | ONE DIRECTION | 10 | 40 | 3.0 | B | F |
| COMPARATIVE EXAMPLE 2 | 30 | 500 | POLYESTER | ONE DIRECTION (INCLINED) | 10 | 40 | 3.0 | B | F |
| COMPARATIVE EXAMPLE 3 | 0 | 150 | POLYESTER | ONE DIRECTION | 10 | 40 | 3.0 | C | F |

LUBRICANT APPLICATOR, CLEANING DEVICE, AND IMAGE FORMING APPARATUS

The entire disclosure of Japanese Patent Application No. 2015-239741 filed on Dec. 8, 2015 including description, claims, drawings, and abstract are incorporated herein by reference in its entirety.

BACKGROUND OF THE INVENTION

Field of the Invention

The present invention relates to a lubricant applicator, a cleaning device, and an image forming apparatus.

Description of the Related Art

An image forming apparatus develops an electrostatic latent image as a toner image by attaching toner (developer) to an image bearing member on which an electrostatic latent image is formed. The toner image is transferred to a recording medium, and fixed to the recording medium by being heated and pressed by a fixing roller. A part of the toner remains on a surface of the image bearing member. The remaining toner forms image noise such as a black point, a stripe, etc., and decreases image quality. Thus, the image forming apparatus includes a cleaning device that removes the remaining toner from the image bearing member using a cleaning blade.

The cleaning device includes a lubricant applicator that applies lubricant to the surface of the image bearing member to decrease a frictional force between the image bearing member and the cleaning blade, thereby protecting the surface of the image bearing member and stabilizing cleaning performance.

The lubricant applicator includes a brush roller that applies a scraped lubricant to the surface of the image bearing member. The brush roller is contaminated with a remaining lubricant, toner shifted from the image bearing member, etc. over time. As a result, the amount of lubricant scraped off by the brush roller and the amount of lubricant applied to the image bearing member are affected, and uniform application of the lubricant is difficult. For this reason, technologies have been proposed to bring a flicker member into contact with the brush roller to flick (flick and separate) contaminating particles of lubricant, toner, etc. (for example, see JP 2015-106004 A, JP 2011-170155 A, and JP 2010-133997 A).

However, when a brush bristle implanted in the brush roller falls out while rubbing and scraping the flicker member, there is a problem in that some separated contaminating particles (lubricant, toner, an external additive thereof) are reattached to the brush bristle. For this reason, separation performance for the contaminating particles is insufficient, and the contaminating particles affect the amount of lubricant scraped off by the brush roller and the amount of lubricant applied to the image bearing member. Thus, there is a problem in that uniformity in lubricant application is limited. In addition, in this way, there occurs a problem of difficulty in exhibiting stable cleaning performance by the cleaning device and excellent image quality by the image forming apparatus.

SUMMARY OF THE INVENTION

The present invention has been conceived to solve the problems associated with the above-described conventional art, and an object of the present invention is to provide a lubricant applicator having excellent uniformity in lubricant application, a cleaning device having stable cleaning performance, and an image forming apparatus having excellent image quality.

The abovementioned object of the present invention is achieved by means below.

(1) To achieve the abovementioned object, according to an aspect, a lubricant applicator incorporated in a cleaning device disposed in an image forming apparatus having an image bearing member on which an image containing toner is formed, reflecting one aspect of the present invention comprises:

a lubricant supplying unit that supplies lubricant;

a brush roller that scrapes off the lubricant to apply the lubricant to a surface of the image bearing member; and a flicker member positioned on an upstream side from the lubricant supplying unit in a rotation direction of the brush roller, the flicker member coming into contact with the brush roller, wherein the flicker member is a plate-shaped member in which an opening is formed, the flicker member having elasticity to be allowed to elastically rock by coming into contact with the brush roller, and the opening is formed in a region with which the brush roller comes into contact.

(2) The lubricant applicator according to Item. 1, wherein the opening preferably has a mesh structure.

(3) The lubricant applicator according to Item. 2, wherein an opening ratio of the region is preferably in a range of 30% to 80%.

(4) The lubricant applicator according to any one of Items. 1 to 3, wherein the plate-shaped member is preferably made of metal.

(5) The lubricant applicator according to Item. 4, wherein a thickness of the flicker member is preferably in a range of 20 μm to 300 μm.

(6) The lubricant applicator according to any one of Items. 1 to 5, wherein the brush roller preferably includes a loop-shaped brush bristle, and a loop formation plane of the brush bristle is preferably in one direction.

(7) The lubricant applicator according to Item. 6, wherein the loop formation plane of the brush bristle preferably intersects with the rotation direction of the brush roller.

(8) The lubricant applicator according to Item. 7, wherein the loop formation plane of the brush bristle is preferably substantially parallel with a direction orthogonal to the rotation direction of the brush roller.

(9) To achieve the abovementioned object, according to an aspect, a cleaning device disposed in an image forming apparatus having an image bearing member on which an image containing toner is formed, reflecting one aspect of the present invention comprises:

the lubricant applicator according to any one of Items. 1 to 8; and a cleaning blade that scrapes off toner remaining on a surface of the image bearing member, wherein the cleaning blade is positioned on a downstream side from the lubricant applicator in a rotation direction of the image bearing member.

(10) To achieve the abovementioned object, according to an aspect, an image forming apparatus reflecting one aspect of the present invention comprises:

the cleaning device according to Item. 9; and an image bearing member on which an image containing toner is formed, wherein a cleaning blade included in the cleaning device scrapes off toner remaining on a surface of the image bearing member, and a brush roller of a lubricant applicator included in the cleaning device applies lubricant to the surface of the image bearing member.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 12 is a table showing results of evaluating image quality in Examples 1 to 6 and Comparative Examples 1 to 3.

DESCRIPTION OF THE PREFERRED EMBODIMENTS

Hereinafter, an embodiment of the present invention will be described with reference to the drawings. However, the scope of the invention is not limited to the illustrated examples. A dimensional ratio of the drawings is exaggerated for convenience of description, and may be different from an actual ratio.

Figure 1:
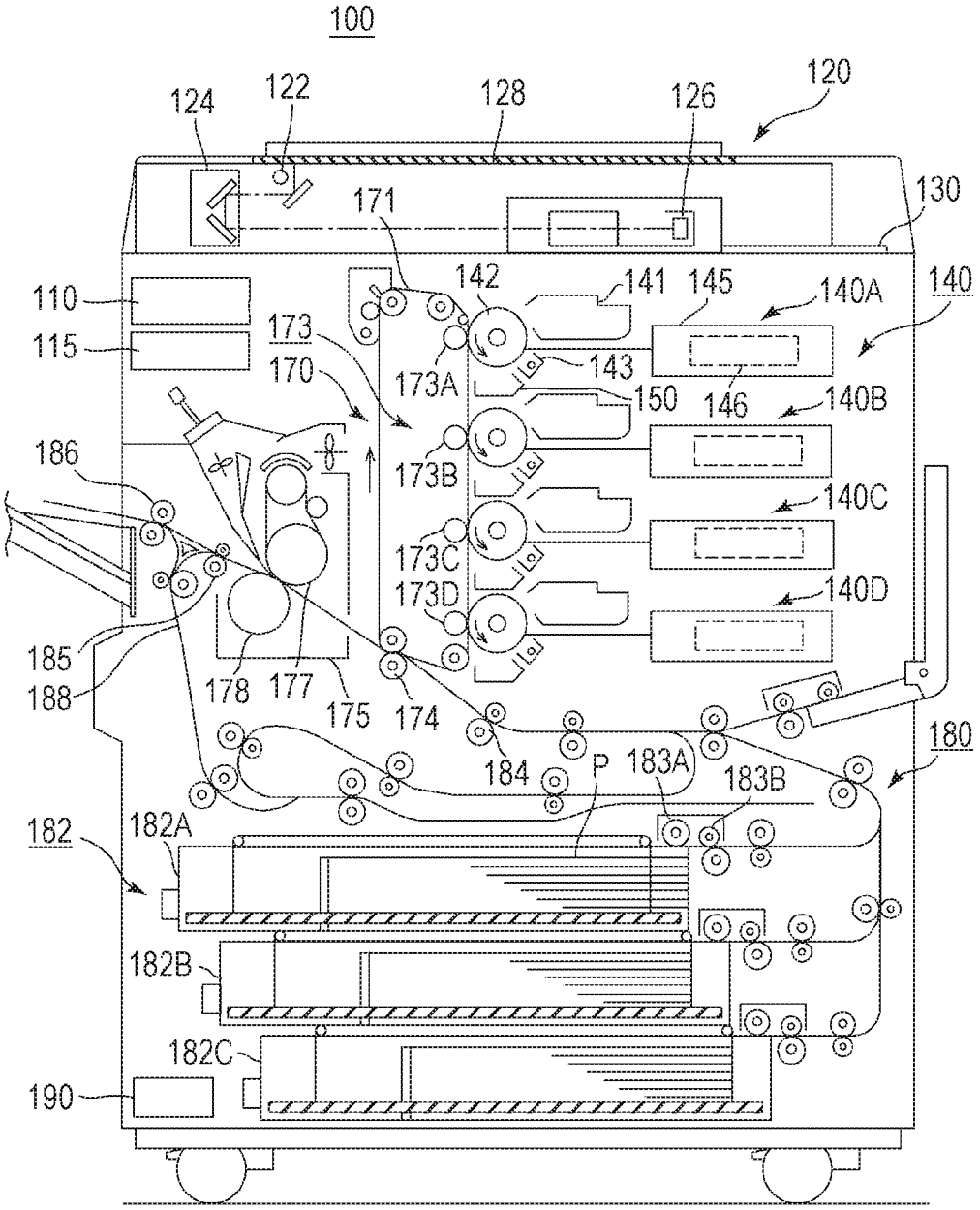
FIG. 1 is a cross-sectional view for description of an image forming apparatus according to an embodiment of the present invention.

FIG. 1 is a cross-sectional view for description of an image forming apparatus according to an embodiment of the present invention.

An image forming apparatus 100 illustrated in FIG. 1 is a multi-function peripheral (MFP) having a copy function, a printer function, and a scanner function, and includes a controller 110, a memory unit 115, an image reading unit 120, an operation display unit 130, an image forming unit 140, a transfer unit 170, a fixing unit 175, a paper conveying unit 180, and a communication interface 190.

The controller 110 is a control circuit including a microprocessor that executes control of the above-mentioned units or various arithmetic processing according to a program, and each function of the image forming apparatus 100 is exhibited when the controller 110 executes a program corresponding thereto.

The memory unit 115 is configured by appropriately combining a high-speed random access memory that serves as a work area to temporarily store a program and data with a high-capacity random access memory that stores various processing programs or various data. Stored data corresponds to image data transmitted from the communication interface 190 or the image reading unit 120, etc. A stored program corresponds to a raster image processing (RIP) (rasterizing) program, etc. RIP corresponds to processing for converting image data into raster image data (bitmap data) used in the image forming unit 140.

The image reading unit 120 is used to generate image data of an original, and includes a light source 122, an optical system 124, and an image pick-up element 126. The light source 122 irradiates an original placed on a reading surface 128 with light, and reflected light thereof passes through the optical system 124 to form an image on the image pick-up element 126 which is moved to a reading position. For example, the image pick-up element 126 includes a line image sensor, and generates an electric signal (performs photoelectric conversion) depending on reflected light intensity. The generated electric signal is input to the image forming unit 140 after image processing. Image processing corresponds to A/D conversion, shading compensation, filtering, image compression processing, etc.

For example, the operation display unit 130 includes a liquid crystal display (LCD) and a key board, and serves both as an output unit and an input unit. The LCD is used to post a configuration, progress of a print job, an error occurrence state, currently changeable setting, etc. for a user. The keyboard has a plurality of keys including a selection key for designating a size of paper P, a ten key for setting the number of copies, etc., a start key for instructing that an operation be started, and a stop key for instructing that an operation be suspended. Furthermore, the keyboard is used to perform various instructions (inputs) such as a character input, various settings, and a start instruction by the user.

The image forming unit 140 is used to form an image on the paper P corresponding to a recording medium using an electrophotographic process. The image forming unit 140 includes an image forming unit 140A that forms a yellow (Y) image, an image forming unit 140B that forms a magenta (M) image, an image forming unit 140C that forms a cyan (C) image, and an image forming unit 140D that forms a black (K) image.

Each of the units of the image forming unit 140 includes a development device 141, a photosensitive drum 142, an electrifying unit 143, a light writing unit 145, and a cleaning device 150.

The development device 141 develops an electrostatic latent image formed on the photosensitive drum 142, and visualize the image using toner. Monochrome toner images corresponding to yellow, magenta, cyan, and black are formed on photosensitive drums 142 of the image forming units 140A, 140B, 140C, and 140D.

The photosensitive drum 142 is an image bearing member having a photosensitive layer made of resin such as polycarbonate including an organic photoconductor (OPC), and is configured to rotate at a predetermined speed. The electrifying unit 143 includes a corona discharge electrode disposed around the photosensitive drum 142, and electrifies a surface of the photosensitive drum 142 using a generated ion.

A scanning optical device 146 is incorporated in the light writing unit 145. When the electrified photosensitive drum 142 is exposed based on raster image data, an electric potential of an exposed portion is decreased, and a charge pattern (electrostatic latent image) corresponding to image data is formed.

The cleaning device 150 is used to maintain an excellent surface state of the photosensitive drum 142 by scraping (removing) toner remaining on the surface of the photosensitive drum 142 after a toner image is transferred to an intermediate transfer belt 171 described below.

The transfer unit 170 includes the intermediate transfer belt 171, a primary transfer unit 173, and a secondary transfer unit 174. The intermediate transfer belt 171 is wound around and movably supported by the primary transfer unit 173 and a plurality of rollers. The primary transfer unit 173 includes primary transfer modules 173A, 173B, 173C, and 173D corresponding to yellow, magenta, cyan, and black. The secondary transfer unit 174 is disposed outside the intermediate transfer belt 171, and positioned such that the paper P may pass between the intermediate transfer belt 171 and the secondary transfer unit 174.

The toner images having the respective colors formed by the image forming units 140A, 140B, 140C, and 140D are successively transferred onto the intermediate transfer belt 171 by the primary transfer modules 173A, 173B, 173C, and 173D, and a toner image in which respective layers of yellow, magenta, cyan, and black are superimposed on one another is formed. The formed toner image is transferred to the conveyed paper P by the secondary transfer unit 174.

The fixing unit 175 is used to fix a color image transferred to the paper P, and includes a heating roller 177 and a pressing roller 178. The paper P is pressed and heated when passing between the heating roller 177 and the pressing roller 178, and the color image is fixed by melting toner.

The paper conveying unit 180 includes a paper feeding unit 182, a resist roller 184, a fixing and conveying roller 185, a paper discharge roller 186, and a paper inverting unit 188.

The paper feeding unit 182 includes paper feeding trays 182A to 182C that accommodate the paper P, a delivery roller 183A, and a handling roller 183B. The delivery roller 183A and the handling roller 183B send papers from the paper feeding trays 182A to 182C one by one to a conveyance path.

The resist roller 184 conveys the paper P fed from the paper feeding unit 182 to the secondary transfer unit 174. The fixing and conveying roller 185 conveys the paper P passing by the secondary transfer unit 174 and the fixing unit 175 toward the paper discharge roller 186. The paper discharge roller 186 discharges the conveyed paper P to the outside of the apparatus.

The paper inverting unit 188 is used to invert and discharge the paper P or form images on both surfaces of the paper P by introducing the paper P passing by the fixing and conveying roller 185 to a conveyance path between the paper feeding trays 182A to 182C and the paper discharge roller 186 rather than a conveyance path directed to the paper discharge roller 186.

The communication interface 190 is an extension device (local area network (LAN) board) connected to a computer via a network to add a communication function for executing transmission and reception of data of a print job, etc. to the image forming apparatus 100. The network includes various networks such as a LAN, a wide area network (WAN) obtained by connecting LANs through an exclusive line, the Internet, a combination thereof, etc. For example, a LAN standard corresponds to Ethernet (registered trademark), a token ring, and a fiber-distributed data interface (FDDI). For example, a communication protocol corresponds to transmission control protocol/Internet protocol (TCP/IP).

Next, the cleaning device 150 will be described in detail.

Figure 2:
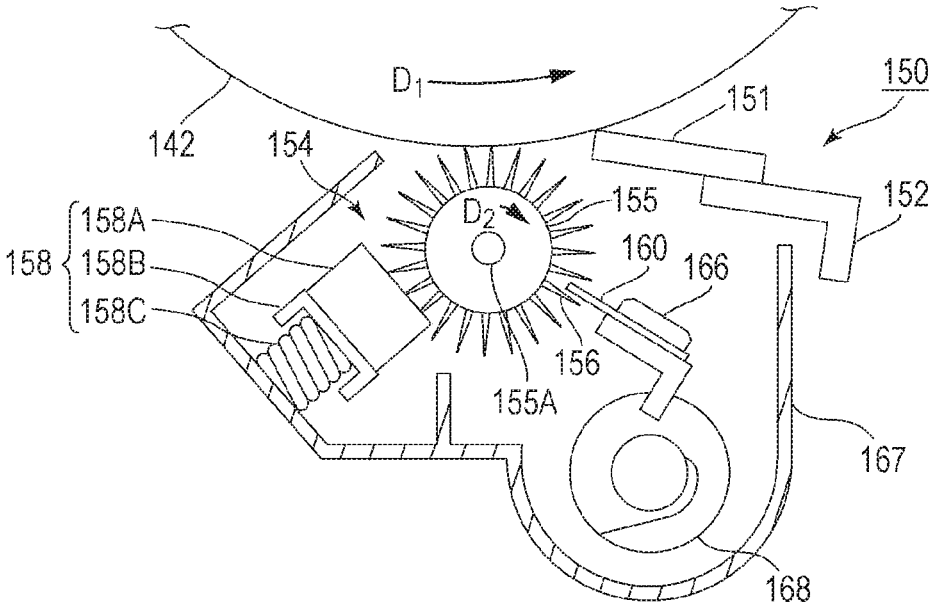
FIG. 2 is a cross-sectional view for description of a cleaning device illustrated in FIG. 1.
Figure 3:
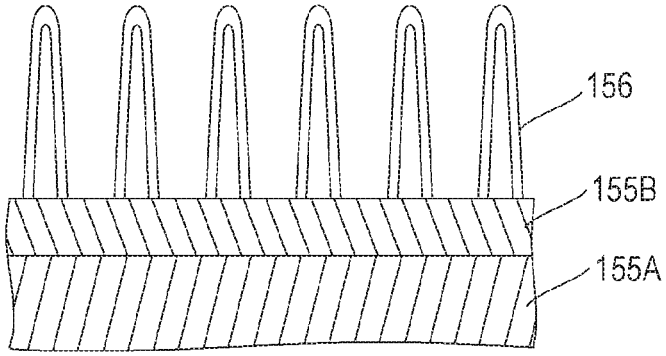
FIG. 3 is a side view for description of an example of a brush bristle of a brush roller of a lubricant applicator illustrated in FIG. 2.
Figure 4:
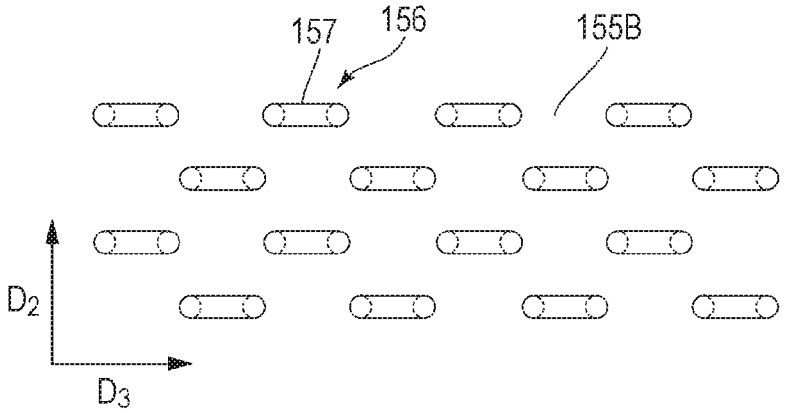
FIG. 4 is a plan view of the brush bristle illustrated in FIG. 3.
Figure 5:
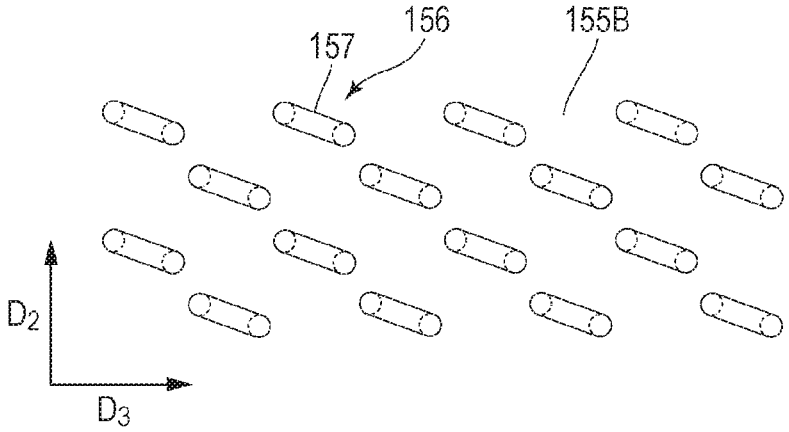
FIG. 5 is a plan view for description of another example of the brush bristle.
Figure 6:
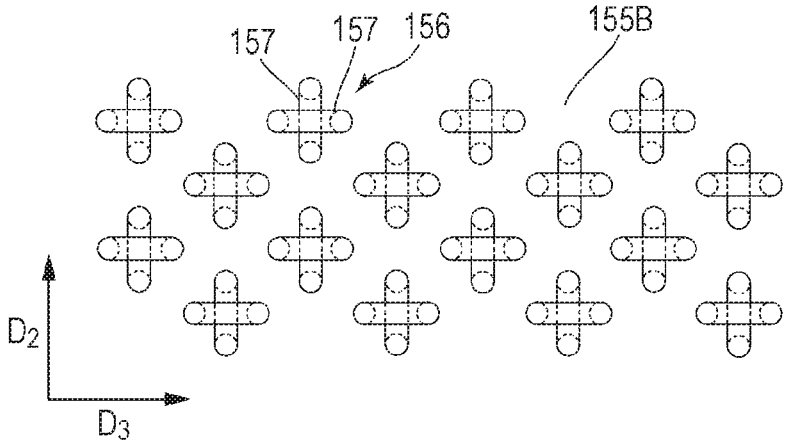
FIG. 6 is a plan view for description of still another example of the brush bristle.

FIG. 2 is a cross-sectional view for description of the cleaning device illustrated in FIG. 1, FIG. 3 is a side view for description of an example of a brush bristle of a brush roller of a lubricant applicator illustrated in FIG. 2, FIG. 4 is a plan view of the brush bristle illustrated in FIG. 3, FIG. 5 is a plan view for description of another example of the brush bristle, and FIG. 6 is a plan view for description of still another example of the brush bristle.

As illustrated in FIG. 2, the cleaning device 150 includes a cleaning blade 151, a blade support 152, and a casing 167. In addition, a lubricant applicator 154 is incorporated in the cleaning device 150.

The cleaning blade 151 is positioned on a downstream side from the lubricant applicator 154 in a rotation direction $D_1$ of the photosensitive drum 142, and used to scrape off toner remaining on the surface of the photosensitive drum 142 corresponding to the image bearing member. For example, the blade support 152 is fixed to the casing 167 to support the cleaning blade 151.

The lubricant applicator 154 includes a brush roller 155, a lubricant supplying unit 158, a flicker member 160, and a flicker member supporting unit 166.

The brush roller 155 includes a brush bristle 156 coming into contact with the surface of the photosensitive drum 142, and is configured to be rotatably driven. The brush bristle 156 is used to apply lubricant to the surface of the photosensitive drum 142.

As illustrated in FIG. 3, the brush bristle 156 is implanted in a loop shape in a ground fabric 155B wound around a shaft portion 155A of the brush roller 155. For example, a material of the brush bristle 156 corresponds to a synthetic resin such as Nylon 6, Nylon 12, polyester, acrylic, vinylon, and aramid, and a mixture of two or more types thereof. Furthermore, the brush bristle 156 has fineness in a range of 2 to 15 denier (D), a density (density of implanting) in a range of 50 to 300 kF/(inch)$^2$, and a bristle length (height) in a range of 2 to 8 mm.

As illustrated in FIG. 4, arrangement of brush bristles 156 corresponds to a zigzag shape. A loop formation plane 157 of the brush bristle 156 is in only one direction, which is substantially parallel with a width direction $D_3$ orthogonal to a rotation direction $D_2$ of the brush roller 155.

The brush bristle 156 is not restricted to the above-described shape. For example, the loop formation plane 157 of the brush bristle 156 is not restricted to the shape substantially parallel with the width direction $D_3$, and may be inclined to intersect with the width direction $D_3$ as illustrated in FIG. 5. An angle of inclination with respect to the rotation direction $D_2$ is preferably set such that brush bristles 156 adjacent to each other in the rotation direction $D_2$ do not overlap each other. For example, the angle is in a range of 20 to 40 degrees.

As illustrated in FIG. 6, the brush bristle 156 may have loop formation planes 157 in two intersecting directions (a direction parallel with the width direction $D_3$ and a direction parallel with the rotation direction $D_2$ of the brush roller 155). Furthermore, a straight bristle not forming a loop may be applied.

The lubricant supplying unit 158 includes a lubricant block 158A, a holder 158B, and an elastic support 158C, and is fixed to the casing 167. The lubricant block 158A is a solid lubricant formed by solidifying a pulverulent body of a melted lubricant in a horn shape. The holder 158B holds the lubricant block 158A. For example, the elastic support 158C has a compression coil spring, and is used to press the lubricant block 158A against the brush bristle 156 of the brush roller 155 (put the lubricant block 158A into contact with the brush bristle 156) through the holder 158B. In this way, the brush bristle 156 may scrape off lubricant from the lubricant block 158A by being rotatably driven.

Lubricant is preferably fatty acid metal salt, and more preferably zinc stearate. Fatty acid metal salt other than zinc stearate, fluororesin, silicone resin, and polyolefin resin may be applied as necessary. Note that fatty acid metal salt refers to a compound obtained by replacing H of fatty acid with a metal ion, and fatty acid refers to monovalent carboxylic acid of long chain hydrocarbon. Examples of metal contained in fatty acid metal salt include zinc, lithium, sodium, magnesium, lead, and nickel. Examples of fatty acid contained in fatty acid metal salt include stearic acid, lauric acid, and palmitic acid.

The flicker member 160 is used to separate contaminating particles such as lubricant remaining on the brush roller 155 or toner shifted from the photosensitive drum 142. The flicker member 160 is positioned on an upstream side from the lubricant block 158A (lubricant supplying unit 158) in the rotation direction $D_2$ of the brush roller 155, and is positioned to come into contact with the brush bristle 156 of the brush roller 155. The flicker member supporting unit 166 is fixed to the casing 167 to support the flicker member 160.

A conveying member 168 is provided in the casing 167. The conveying member 168 is used to discharge toner removed from the surface of the photosensitive drum 142 by the cleaning blade 151 and contaminating particles separated from the brush roller 155 by the flicker member 160 (lubricant, toner, and an external additive thereof) from the cleaning device 150. The conveying member 168 is disposed below the cleaning blade 151 and the flicker member 160 such that the removed toner and the separated contaminating particles fall due to empty weights thereof. For example, the toner and the contaminating particles discharged from the cleaning device 150 are introduced to a collection container (not illustrated) replaceably disposed in an empty space at a bottom of the image forming apparatus 100 via a conveyance path provided inside the image forming apparatus 100.

Next, the flicker member 160 will be described in detail.

Figure 7:
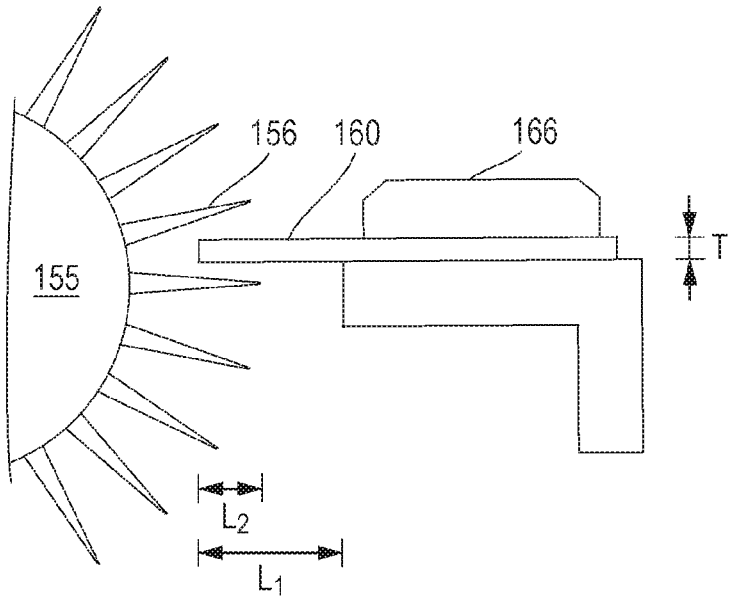
FIG. 7 is a side view for description of a flicker member of the lubricant applicator illustrated in FIG. 2.
Figure 8:
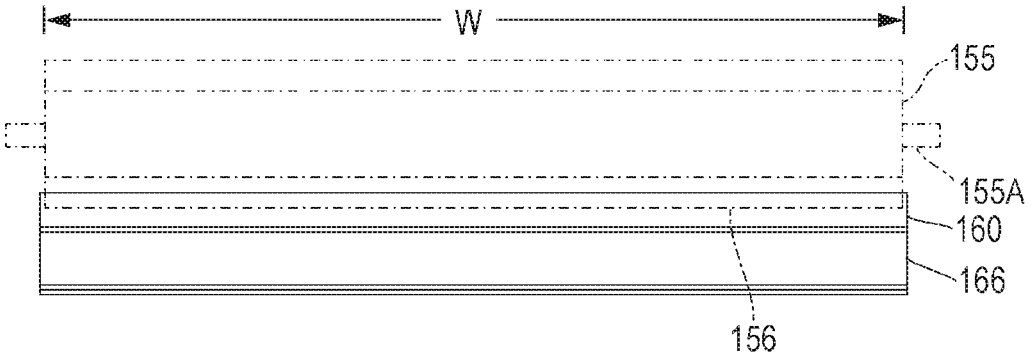
FIG. 8 is a plan view for description of the flicker member of the lubricant applicator illustrated in FIG. 2.
Figure 9:
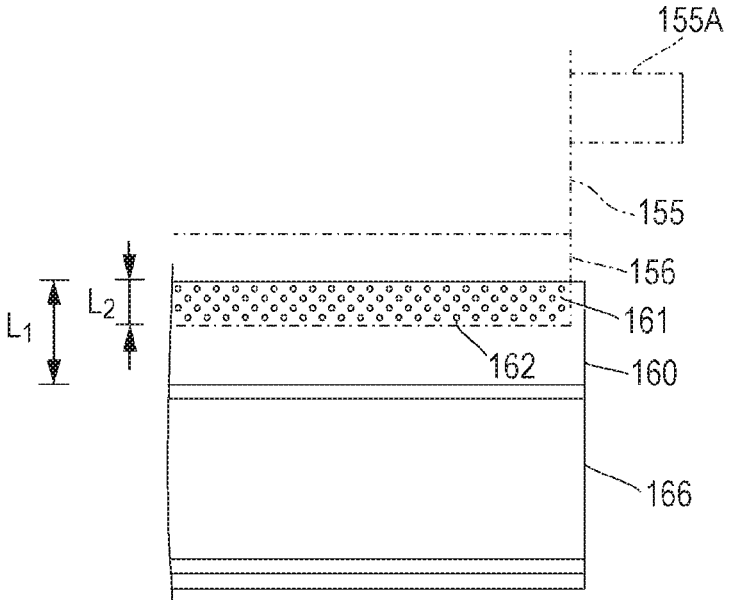
FIG. 9 is an enlarged view of a main part of FIG. 8.
Figure 10:
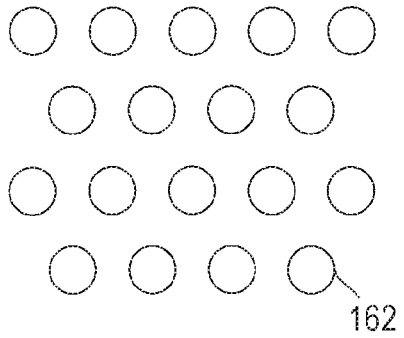
FIG. 10 is a schematic view for description of an example of an opening illustrated in FIG. 9.
Figure 11:
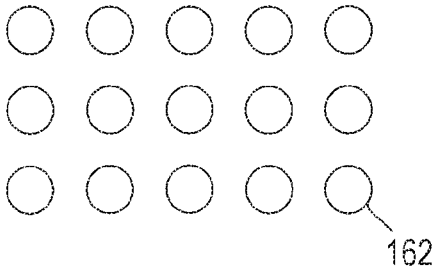
FIG. 11 is a schematic view for description of another example of the opening.

FIG. 7 and FIG. 8 are a side view and is a plan view for description of the flicker member of the lubricant applicator illustrated in FIG. 2, FIG. 9 is an enlarged view of a main part of FIG. 8, FIG. 10 is a schematic view for description of an example of an opening illustrated in FIG. 9, and FIG. 11 is a schematic view for description of another example of the opening.

The flicker member 160 is a substantially rectangular plate-shaped member, is disposed parallel with the brush roller 155 as illustrated in FIG. 8, and has an opening 162 as illustrated in FIG. 9.

For example, the flicker member 160 is made of austenitic stainless steel (SUS 304) having a thickness T of less than 500 μm. As illustrated in FIG. 7, the flicker member 160 has elasticity to be allowed to elastically rock (warp and vibrate) by coming into contact with the rotatably driven brush roller 155 (brush bristle 156).

Therefore, contaminating particles (lubricant, toner, and an external additive thereof) remaining on the brush roller 155 is more easily separated since impact, in which a dashing force of the rotating brush bristle 156 and a restoring force of the flicker member 160 are combined, acts when the flicker member 160 and the brush roller 155 come into contact with each other. In other words, the flicker member 160 may suitably separate the contaminating particles remaining on the brush roller 155 by flicking the contaminating particles.

Stainless steel other than austenitic stainless steel or metal such as phosphor bronze may be applied to a material of the flicker member 160. Alternatively, a resin material may be applied when the flicker member 160 has sufficient elasticity to be allowed to elastically rock (warp) by coming into contact with the brush roller 155 (brush bristle 156). Metal is preferable in that metal has excellent elasticity and the opening 162 is easily formed therein. In addition, a free length $L_1$ of the flicker member 160 is preferably in a range of 3 mm to 10 mm.

For example, the opening 162 of the flicker member 160 has a circular shape as illustrated in FIG. 10, and openings 162 are disposed in a zigzag shape in a region (contact region) 161, with which the brush roller 155 comes into contact, to form a mesh structure. The contact region 161 is an area defined by a width W of the brush roller 155 and a maximum length $L_2$ in which a bristle tip of the brush bristle 156 enters (see FIGS. 7 and 9).

Therefore, the flicker member 160 elastically rocks (warps and vibrates) by coming into contact with the rotating brush roller 155 (brush bristle 156). In addition, when the flicker member 160 flicks contaminating particles such as lubricant remaining on the brush roller 155 or toner shifted from the photosensitive drum 142, some contaminating particles are separated through the opening 162. The contaminating particles separated through the opening 162 are inhibited from being reattached to the brush roller 155. Thus, the amount of contaminating particles is further reduced (contamination of the brush roller 155 is suppressed) when compared to a case in which the opening 162 is not provided. In other words, an influence of contaminating particles on the amount of lubricant scraped off by the brush roller and the amount of lubricant applied to the image bearing member is further decreased, and uniformity in lubricant application is improved.

A size of the opening 162 is set in consideration of a size of a contaminating particle of the brush roller 155 and the free length $L_1$ of the flicker member 160. For example, the size of the opening 162 is 500 μm (diameter). A method of forming the opening 162 is not particularly restricted, and etching processing or machining may be applied. A shape of the opening 162 is not restricted to a circular shape. For example, it is possible to apply an oval shape, a triangular shape, a rectangular shape, an oblong shape, and a polygonal shape having five or more sides. Arrangement of the openings 162 is not restricted to the zigzag shape, and the openings 162 may be aligned and disposed as illustrated in FIG. 11. An installation position of the opening 162 is not restricted to the contact region 161.

As described above, the lubricant applicator 154 has excellent uniformity in lubricant application. Therefore, the cleaning device 150 in which the lubricant applicator 154 is incorporated may decrease a frictional force between the photosensitive drum 142 and the cleaning blade 151, and protect the surface of the image bearing member. For example, durability of the cleaning blade 151 may be ensured by reducing the amount at which toner dashes against an edge portion of the cleaning blade 151, and stable cleaning performance may be exhibited by preventing poor cleaning in association with scratch or chip due to winding of the cleaning blade 151. Furthermore, the image forming apparatus 100 having the cleaning device 150 may reduce image noise such as a block point or stripe resulting from poor cleaning, and improve image quality.

Next, a description will be given of results of evaluating image quality of the image forming apparatus 100.

FIG. 12 is a table showing results of evaluating image quality in Examples 1 to 6 and Comparative Examples 1 to 3.

Image quality of the image forming apparatus 100 was evaluated by visually observing image unevenness when halftone A4 image data was printed after printing 25,000 and 50,000 pieces of A4 image data, the entire of which is black, respectively. Evaluations A, B, C, and F indicate excellent, favorable, acceptable, and practically unacceptable levels.

Common conditions of a lubricant applicator incorporated in the image forming apparatus 100 were that a pressure force of a lubricant block to a brush roller was 3.5 N, brush bristles were disposed in the zigzag shape, the amount at which a flicker member goes into the brush roller was 1.3 mm, a material of the flicker member was austenitic stainless steel (SUS 304), and a free length of the flicker member was 6.5 mm.

Conditions of Example 1 were that a brush bristle was an acrylic straight bristle having a bristle length of 3.0 mm, fineness was 6 denier (D), a density was 100 kF/(inch)$^2$, a thickness of a flicker member was 300 μm, and an opening ratio of a contact region was 30%.

Conditions of Example 2 were that a brush bristle was a polyester loop-shaped bristle (loop formation planes in two intersecting directions) (see FIG. 6) having a bristle length of 3.0 mm, fineness was 6 denier (D), a density was 40 kF/(inch)$^2$, a thickness of a flicker member was 100 μm, and an opening ratio of a contact region was 50%.

Conditions of Example 3 were that a brush bristle was a polyester loop-shaped bristle (having a loop formation plane in only one direction) (see FIG. 4) having a bristle length of 3.0 mm, fineness was 10 denier (D), a density was 40 kF/(inch)$^2$, a thickness of a flicker member was 200 μm, and an opening ratio of a contact region was 60%.

Conditions of Example 4 are the same as the conditions of Example 3 except that the loop formation plane is inclined (an angle of inclination is the same as that of FIG. 5, similarly applied hereinafter).

Conditions of Example 5 were that a brush bristle was a polyester loop-shaped bristle (having a loop formation plane in only one direction) having a bristle length of 4.0 mm, fineness was 3 denier (D), a density was 100 kF/(inch)$^2$, a thickness of a flicker member was 50 μm, and an opening ratio of a contact region was 50%.

Conditions of Example 6 were that a brush bristle was a polyester loop-shaped bristle (having a loop formation plane in only one direction) having a bristle length of 3.0 mm, fineness was 3 denier (D), a density was 225 kF/(inch)$^2$, a thickness of a flicker member was 25 μm, and an opening ratio of a contact region was 80%.

Conditions of Comparative Example 1 were that a brush bristle was a polyester loop-shaped bristle (having a loop formation plane in only one direction) having a bristle length of 3.0 mm, fineness was 10 denier (D), a density was 40 kF/(inch)$^2$, a thickness of a flicker member was 500 μm, and an opening ratio of a contact region was 30%. The flicker member of Comparative Example 1 is a substantially rigid body, and does not have elasticity to be allowed to elastically rock by coming into contact with a brush roller (the brush bristle).

Conditions of Comparative Example 2 are the same as the conditions of Comparative Example 1 except that the loop formation plane is inclined.

Conditions of Comparative Example 3 were that a brush bristle was a polyester loop-shaped bristle (having a loop formation plane in only one direction) having a bristle length of 3.0 mm, fineness was 10 denier (D), a density was 40 kF/(inch)$^2$, and a thickness of a flicker member was 150 μm. The flicker member of Comparative Example 3 does not have any opening.

In Examples 1 to 6, the opening ratio was in a range of 30% to 80% and the thickness of the flicker member was in a range of 25 μm to 300 μm. Furthermore, as illustrated in FIG. 12, evaluations corresponded to A or B, and results were acceptable.

In particular, Examples 3 to 6 having the loop formation plane in only one direction were all evaluated as A, and were more excellent than Comparative Example 2 having the loop formation planes in two intersecting directions. A reason for these evaluation results is conjectured as follows. When the loop formation plane is only in one direction, the flicker member easily goes deep into (enters) the brush bristle, the amount at which the flicker member and the brush bristle warp is maximized, a restoring force increases, and thus separation performance is improved.

Example 2 having the loop formation planes in two intersecting directions were more excellent than Example 1 which does not have any loop formation plane (straight bristle). A reason for this evaluation result is conjectured as follows. When a loop formation plane is included, a surface comes into contact with the flicker member, and thus impact of contact is larger when compared to a straight brush bristle corresponding to line contact, and separation efficiency is improved.

On the other hand, Comparative Examples 1 to 3 were evaluated as B or C. In particular, evaluation after 50,000 pieces were printed was F, which was a practically unacceptable level. A reason for these evaluation results is as follows. In Comparative Examples 1 and 2, even though the flicker member has the opening, the flicker member is the substantially rigid body, and does not have elasticity to be allowed to elastically rock by coming into contact with the brush roller. In Comparative Example 3, even though the flicker member is a thin plate, and has elasticity to be allowed to elastically rock by coming into contact with the brush roller, no opening is formed.

Therefore, the opening ratio of the flicker member in a region with which the brush roller comes into contact is preferably in a range of 30% to 80%, and more preferably in a range of 50% to 80%. The thickness of the flicker member is preferably less than or equal to 300 μm, and more preferably less than or equal to 200 μm. The thickness of the flicker member is preferably greater than or equal to 20 μm, and more preferably greater than or equal to 25 μm in consideration of strength, elasticity, etc. of the flicker member.

As described in the foregoing, according to the lubricant applicator pertaining to the present embodiment, the flicker member elastically rocks by coming into contact with the brush roller, and contaminating particles such as lubricant remaining on the brush roller or toner shifted from the image bearing member are flicked. In addition, in this instance, some contaminating particles (lubricant and toner) are separated via the opening disposed in a region with which the brush roller comes into contact with. The contaminating particles separated via the opening are inhibited from being reattached to the brush roller, and thus the amount of contaminating particles is further reduced when compared to a case in which the opening is not included. Therefore, an influence of contaminating particles on the amount of lubricant scraped off by the brush roller and the amount of lubricant applied to the image bearing member is further decreased, and uniformity in lubricant application is improved.

The cleaning device according to the present embodiment includes the lubricant applicator having excellent uniformity in lubricant application. For this reason, a frictional force between the image bearing member and the cleaning blade may be decreased, and the surface of the image bearing member may be protected. For example, durability of the cleaning blade may be ensured by reducing the amount at which toner dashes against the edge portion of the cleaning blade, and stable cleaning performance may be exhibited by preventing poor cleaning in association with scratch or chip due to winding of the cleaning blade.

The image forming apparatus according to the present embodiment includes the cleaning device having stable cleaning performance. For this reason, it is possible to reduce image noise such as a block point or stripe resulting from poor cleaning, and improve image quality.

Therefore, the present embodiment may provide the lubricant applicator having excellent uniformity in lubricant application, the cleaning device having stable cleaning performance, and the image forming apparatus having excellent image quality.

The present invention is not restricted to the above-described embodiment, and may be variously modified within the scope of claims. For example, the image bearing member having the surface to which lubricant is applied by the brush roller is not restricted to the photosensitive drum, and is applicable to a photoreceptor belt. In addition, the image forming apparatus is not restricted to the MFP, and is applicable to, for example, a printer, a copy machine, and a facsimile machine.

Although the present invention has been described and illustrated in detail, it is clearly understood that the same is by way of illustrated and example only and is not to be taken byway of limitation, the scope of the present invention being interpreted by terms of the appended claims.

What is claimed is:

1. A lubricant applicator incorporated in a cleaning device disposed in an image forming apparatus having an image bearing member on which an image containing toner is formed, the lubricant applicator comprising:

a lubricant supplying unit that supplies lubricant;

a brush roller that scrapes off the lubricant to apply the lubricant to a surface of the image bearing member; and a flicker member positioned on an upstream side from the lubricant supplying unit in a rotation direction of the brush roller, the flicker member coming into contact with the brush roller, wherein the flicker member is a plate-shaped member in which an opening is formed, the flicker member having elasticity to be allowed to elastically rock by coming into contact with the brush roller, and the opening is formed in a region with which the brush roller comes into contact.

2. The lubricant applicator according to claim 1, wherein the opening has a mesh structure.

3. The lubricant applicator according to claim 2, wherein an opening ratio of the region is in a range of 30% to 80%.

4. The lubricant applicator according to claim 1, wherein the plate-shaped member is made of metal.

5. The lubricant applicator according to claim 4, wherein a thickness of the flicker member is in a range of 20 μm to 300 μm.

6. The lubricant applicator according to claim 1, wherein the brush roller includes a loop-shaped brush bristle, and a loop formation plane of the brush bristle is in one direction.

7. The lubricant applicator according to claim 6, wherein the loop formation plane of the brush bristle intersects with the rotation direction of the brush roller.

8. The lubricant applicator according to claim 7, wherein the loop formation plane of the brush bristle is substantially parallel with a direction orthogonal to the rotation direction of the brush roller.

9. A cleaning device disposed in an image forming apparatus having an image bearing member on which an image containing toner is formed, the cleaning device comprising:

the lubricant applicator according to claim 1; and a cleaning blade that scrapes off toner remaining on a surface of the image bearing member, wherein the cleaning blade is positioned on a downstream side from the lubricant applicator in a rotation direction of the image bearing member.

10. An image forming apparatus comprising:

the cleaning device according to claim 9; and an image bearing member on which an image containing toner is formed, wherein a cleaning blade included in the cleaning device scrapes off toner remaining on a surface of the image bearing member, and a brush roller of a lubricant applicator included in the cleaning device applies lubricant to the surface of the image bearing member.

* * * * *